US007063577B2

(12) United States Patent
Fujita et al.

(10) Patent No.: US 7,063,577 B2
(45) Date of Patent: Jun. 20, 2006

(54) SPLIT-TYPE CONNECTOR ASSEMBLY AND METHOD OF ASSEMBLING IT

(75) Inventors: Shinya Fujita, Yokkaichi (JP); Toshikazu Sakurai, Yokkaichi (JP); Hitoshi Okumura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 348 days.

(21) Appl. No.: 10/431,884

(22) Filed: May 8, 2003

(65) Prior Publication Data

US 2003/0211785 A1 Nov. 13, 2003

(30) Foreign Application Priority Data

May 8, 2002 (JP) ..... 2002-132658
May 8, 2002 (JP) ..... 2002-132756

(51) Int. Cl.
*H01R 13/502* (2006.01)

(52) U.S. Cl. ..... 439/701

(58) Field of Classification Search ..... 439/701, 439/680, 681
See application file for complete search history.

(56) References Cited

U.S. PATENT DOCUMENTS 4,596,436 A * 6/1986 Kraemer et al. ..... 439/701
4,915,641 A * 4/1990 Miskin et al. ..... 439/247
5,902,155 A * 5/1999 Polgar et al. ..... 439/680
6,135,822 A * 10/2000 Hwang ..... 439/680

FOREIGN PATENT DOCUMENTS

JP 9-219238 2/1997
JP 2001-224873 8/2001

* cited by examiner

*Primary Examiner*—Thanh-Tam Le
(74) *Attorney, Agent, or Firm*—Gerald E. Hespos; Anthony J. Casella

(57) ABSTRACT

A male connector (M) has male housings (20A, 20B, 20C) and is connectable with a female connector (F) with female housings (40A, 40B, 40C). Error connection preventing projections (28A, 28B) of the male housings (20A, 20B) are received in receiving portions (47A, 47B) of the female housings (40A, 40B) to connect the two connectors (M, F) properly if the combination of the housings in the male and female connectors (M, F) is correct. However, the error connection preventing projections (28A, 28B) on the male housings (20A, 20B) interfere with opposed the female housings (40B, 40C) and hinder connection of the two connectors (M, F) if the combination of housings is incorrect.

5 Claims, 22 Drawing Sheets

SPLIT-TYPE CONNECTOR ASSEMBLY AND METHOD OF ASSEMBLING IT

BACKGROUND OF THE INVENTION

1. Field of the Invention

The invention relates to a split-type connector that accommodates auxiliary connector housings in a frame.

2. Description of the Related Art

Japanese Patent Application No. 2001-224873 and FIG. 14 herein show a split-type connector developed by the assignee of the subject invention. The connector of FIG. 14 has six accommodating chambers 1 formed in a frame 2, and three kinds of auxiliary connector housings 3A, 3B, 3C can be accommodated in the accommodating chambers 1. Female terminal fittings 4A, 4B, 4C of different sizes can be mounted in the three kinds of auxiliary connector housings 3A, 3B, 3C. The kind(s) and the number(s) of the auxiliary connector housings 3A, 3B, 3C and the positions of the accommodating chambers 1 into which the respective auxiliary connector housings 3A, 3B, 3C are accommodated are determined in accordance with a circuit construction or the like. An unillustrated mating male connector similarly is comprised of a frame with six accommodating chambers and three kinds of auxiliary connector housings to be mounted into the accommodating chambers. The male and female connectors are connected so that the leading ends of male terminal fittings in the male auxiliary connector housings are inserted into the female terminal fittings 4A, 4B, 4C of the corresponding female auxiliary connector housings 3A, 3B, 3C at positions opposed to the male auxiliary connector housings. Thus, the male and female terminal fittings are connected.

The same frame can be used for different kinds of auxiliary connector housings in the above-described connector. Consequently, the connector can deal flexibly with various circuit constructions. On the other hand, an operator may mount the auxiliary connector housing into the wrong accommodating chamber of the frame. As a result, the leading ends of the small male terminal fittings may be inserted into large female terminal fittings. The two connectors then may be connected and the operator may not notice an error.

Japanese Unexamined Patent Publication No. 9-219238 discloses a split-type connector with auxiliary connector housings accommodated in a plurality of accommodating chambers of a frame. Each auxiliary connector housing has a plurality of cavities into which terminal fittings are insertable, and the terminal fittings are held in cavities by resilient locks. A retainer mount hole is formed in the outer surface of each auxiliary connector housing and communicates with the respective cavities. A retainer is mounted in the retainer mount hole to engage and doubly lock the terminal fittings.

The separate retainer of the above-described auxiliary connector housing requires a relatively large holding construction to hold the retainer at a specified position. Hence, the entire split-type connector must be large. Consideration has been given to a retainer joined integrally near the opening edge of a retainer mount hole by a hinge. Thus, the retainer holding construction can be simplified, and the connector can be miniaturized. The retainer can be pivoted about the hinge between an open position and closed position where the retainer engages and locks the terminal fittings. However, the retainer is locked in the auxiliary connector housing with a relatively small locking force.

Therefore, the retainer may undergo an opening deformation from the closing position, and may disengage from the terminal fittings when an impact acts on the retainer. As a result, the retainer may not be able to exert proper forces to hold the terminal fittings.

The invention was developed in view of the above problem and an object thereof is to improve operability of a split-type connector assembly.

SUMMARY OF THE INVENTION

The invention relates to a split-type connector assembly with first and second connectors that are engageable with each other. The first connector includes a first frame formed with accommodating chambers and a plurality of kinds of first auxiliary connector housings that can be accommodated in the respective accommodating chambers. The second connector has a second frame formed with accommodating chambers and a plurality of kinds of second auxiliary connector housings that can be accommodated in the respective accommodating chambers. At least one error connection preventing means is provided between the first and second auxiliary connector housings for permitting proper connection of the two connectors if the auxiliary connector housings of corresponding kinds are opposed to each other. However, the error connection preventing means hinders proper connection of the two connectors if the auxiliary connector housings of uncorresponding kinds are opposed to each other. Accordingly, the split-type connector assembly prevents connectors from being connected in a wrong correspondence of auxiliary connector housings.

Terminal fittings in the first auxiliary connector housings and those in the corresponding second auxiliary connector housings opposed to the first auxiliary connector housings are connected together by properly connecting the first and second connectors.

The error connection preventing means preferably comprises at least one error connection preventing projection that project forward substantially in a connecting direction from the first auxiliary connector housings. The error preventing projections preferably have different shapes depending on the kinds of auxiliary, connector housings. The error connection preventing means may further comprise at least one corresponding receiving portion formed in the second auxiliary connector housings for receiving only the error connection preventing projections of the first auxiliary connector housings of the corresponding kind. The error connection preventing projections are received in the corresponding receiving portions and permit proper connection if the auxiliary connector housings of corresponding kinds are opposed to each other. However, the error connection preventing projections interfere with the second auxiliary connector housings and hinder connection if the auxiliary connector housings of uncorresponding kinds are opposed to each other.

The first and second auxiliary connector housings may differ in kind depending on the sizes of terminal fittings mounted therein. Accordingly, a small male terminal fitting will not be inserted into a large female terminal fitting when an attempt is made to connect the two connectors in a wrong correspondence of the first and second auxiliary connector housings.

The invention also relates to a method of assembling the above-described split-type connector assembly. The method comprises engaging the first and second connectors with each other and detecting if the auxiliary connector housings of uncorresponding kinds are opposed to each other upon connecting the first and second connectors by means of one or more error connection preventing means provided between the first auxiliary connector housings.

According to the preferred method, the error connection preventing projections are received in the corresponding receiving portions and proper connection of the connectors is permitted if the auxiliary connector housings of corresponding kinds are opposed to each other. However, the error connection preventing projections interfere with the second auxiliary connector housings and hinder connection if the auxiliary connector housings of uncorresponding kinds are opposed to each other.

The invention also relates to a split-type connector that comprises a frame formed with accommodating chambers. Auxiliary connector housings are insertable into the accommodating chambers. Each auxiliary connector housing has at least one cavity for receiving corresponding terminal fittings. A retainer mount hole is formed in an outer surface of each auxiliary connector housing and communicates with the cavities. A retainer is mountable into the corresponding retainer mount hole to engage and lock the terminal fittings. Each retainer is provided integrally or unitarily at the opening edge of the corresponding retainer hole via a hinge and can open and close. An opening deformation of the retainer from a closing position where the retainer engages the terminal fittings to a position where the retainer is disengaged from the terminal fittings is hindered by the frame. The hinge provides a simple holding of the retainer on the connector housing. Accordingly, the split-type connector can be miniaturized. Further, the opening deformation of the retainer from the closing position to the position where the retainer is disengaged from the terminal fittings is hindered by the frame. Hence the retainer securely exerts forces to hold the terminal fittings.

Molds for a connector are complex if the retainer and the lock projection are arranged one after the other along forward and backward directions in view of the need to remove the connector from the molds. However, molds for the subject invention are simplified by forming the lock projection integrally on the retainer.

The front surface of each lock projection preferably is a hindering surface for contacting the opening edge of the accommodating chamber to hinder the insertion of the auxiliary connector housing into the accommodating chamber when the retainer is displaced from the closing position.

An attempt could be made to insert the auxiliary connector housing into the accommodating chamber when the retainer is not in the closing position due to an insufficiently inserted terminal fitting. However, the front surface of the lock projection will contact the opening edge of the accommodating chamber, and will hinder the insertion of the auxiliary connector housing. Thus the auxiliary connector housing cannot be assembled while the terminal fitting is inserted insufficiently.

The front surface of the lock projection extends at an angle to an inserting direction of the auxiliary housing into the accommodating chamber when the retainer is at the closing position.

The retainer is deformed slightly to be arranged at the closing position while being engaged with the corresponding retainer mount hole.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
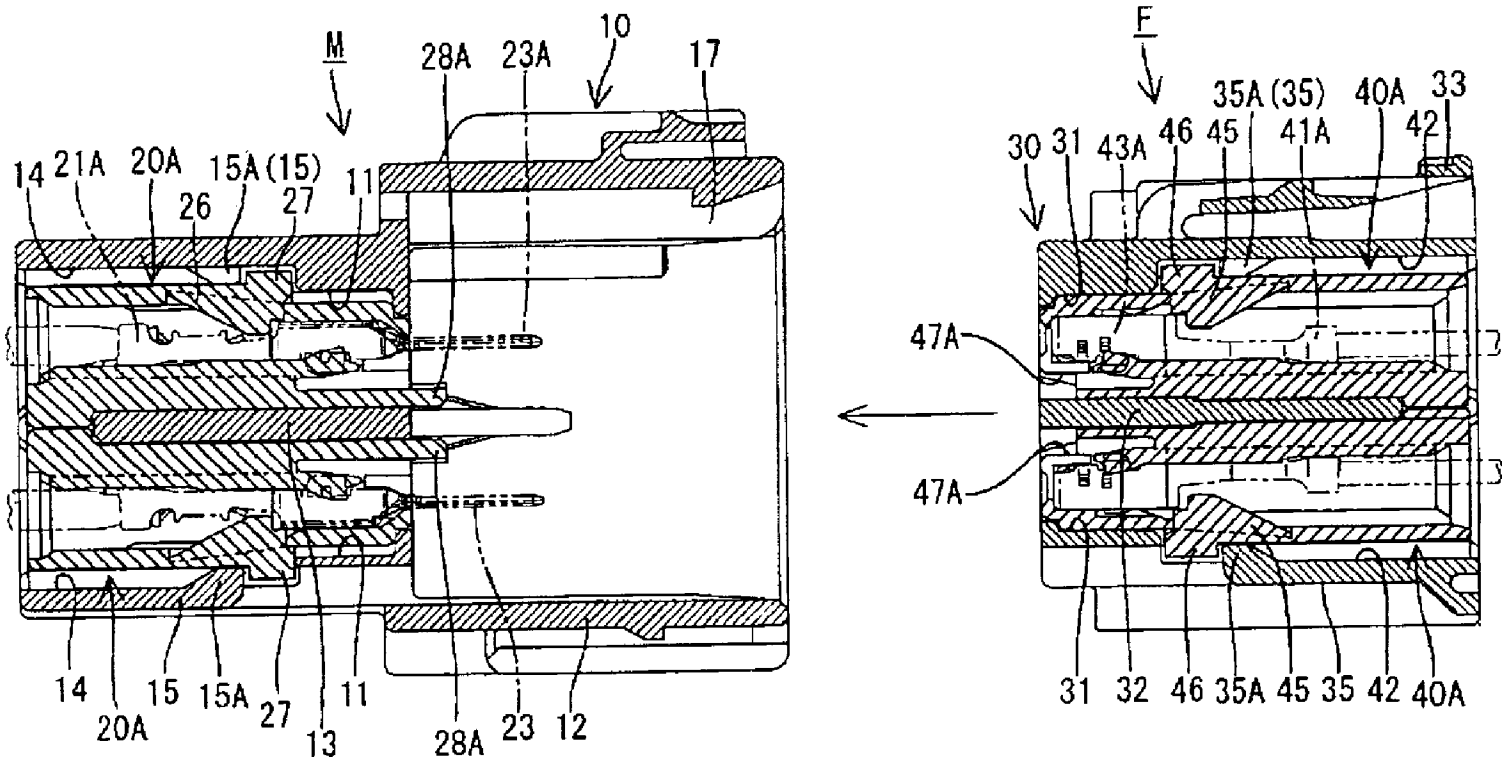
FIG. 1 is a side view in section showing a state before split-type male and female connectors are connected in a first embodiment of the invention.

A split-type connector assembly according to a first embodiment of the invention is described with reference to FIGS. 1 to 13. The assembly includes male and female split-type connectors F, M that are connectable with each other as shown in FIG. 1. In the following description, sides of the male split-type connector M and the female split-type connector F to be connected with each other are referred to as the front sides.

The male split-type connector M has a male frame 10 formed with a plurality of accommodating chambers 11, and three kinds of male auxiliary connector housings 20A, 20B, 20C that can be accommodated in the accommodating chambers 11.

Figure 2:
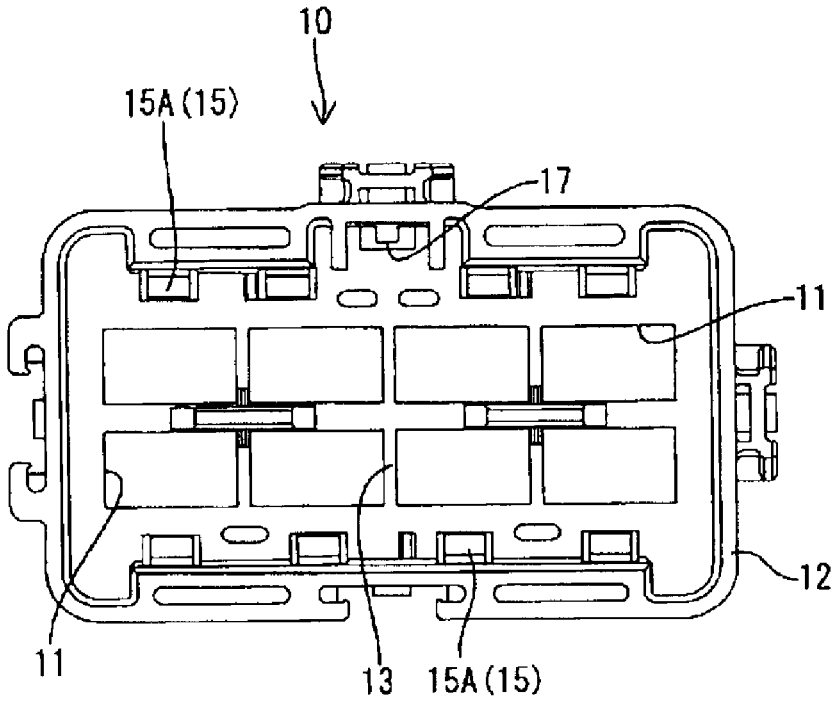
FIG. 2 is a front view of a male frame.
Figure 3:
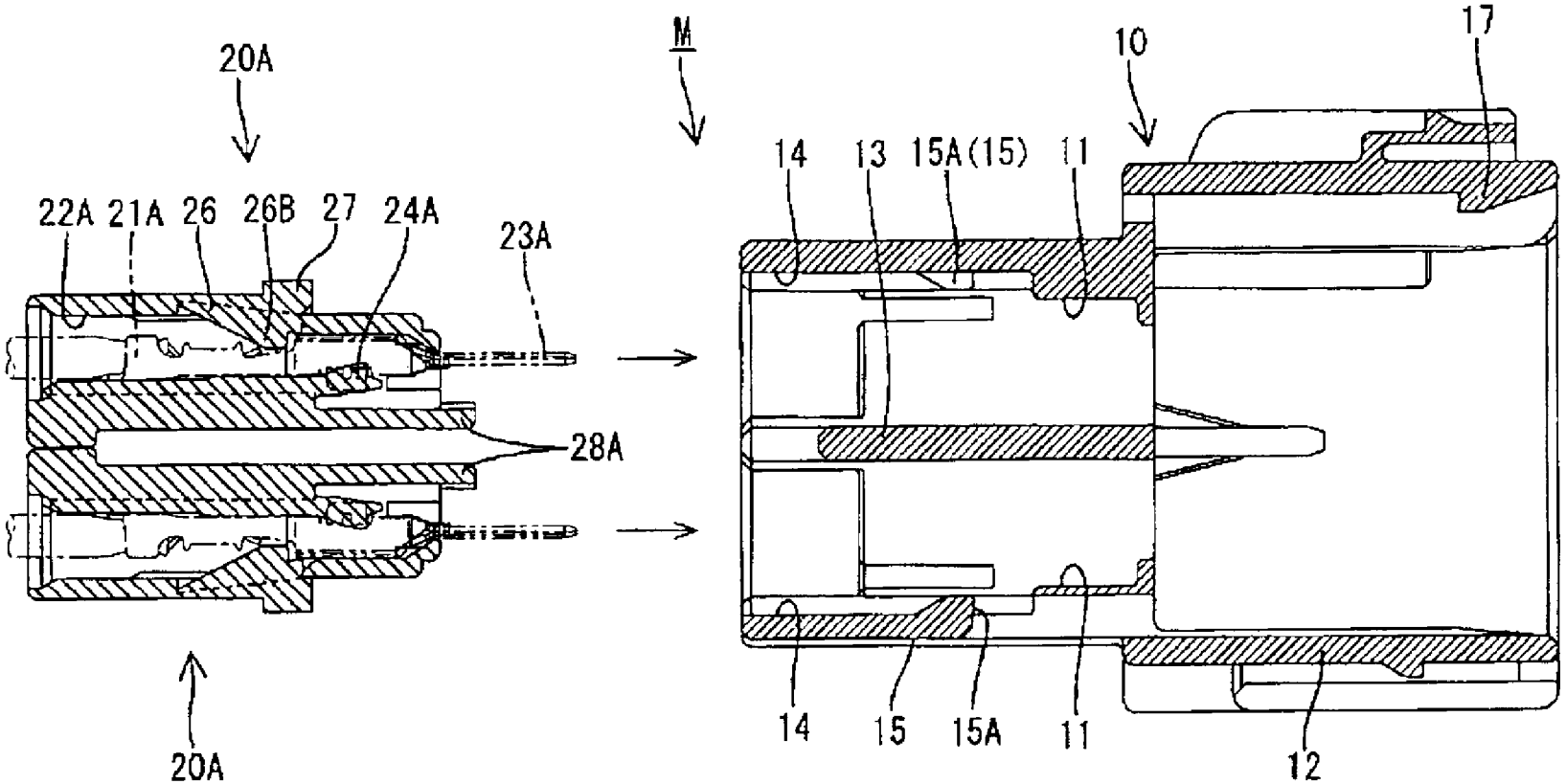
FIG. 3 is an exploded side view in section of the male frame and a male housing.

The male frame 10 is made e.g. of a synthetic resin, and has opposite front and rear ends. A substantially rectangular tubular receptacle 12 opens forward at the front end of the male frame 10, as shown in FIGS. 2 and 3. A rear part of the male frame 10 is cross-sectionally slightly smaller than the receptacle 12, and includes eight accommodating chambers 11 separated by a lattice-shaped array of partition walls 13. The accommodating chambers 11 are arranged in upper and lower stages, and hence define four substantially symmetrical vertical pairs of accommodating chambers 11. Each accommodating chamber 11 is substantially rectangular and opens forward and back.

Figure 4A:
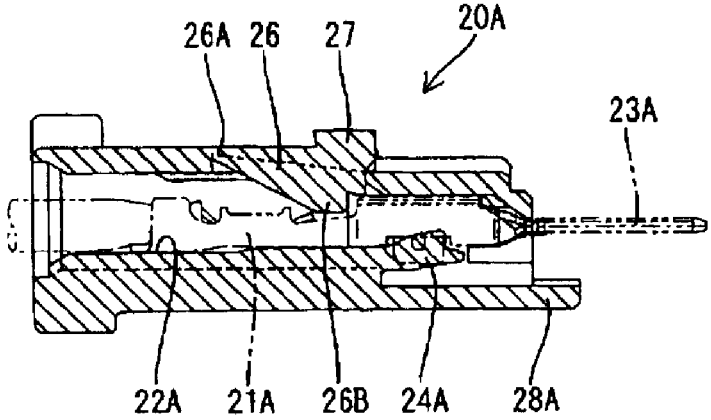
FIGS. 4(A), 4(B) and 4(C) are side views in section showing three kinds of male housings.
Figure 4B:
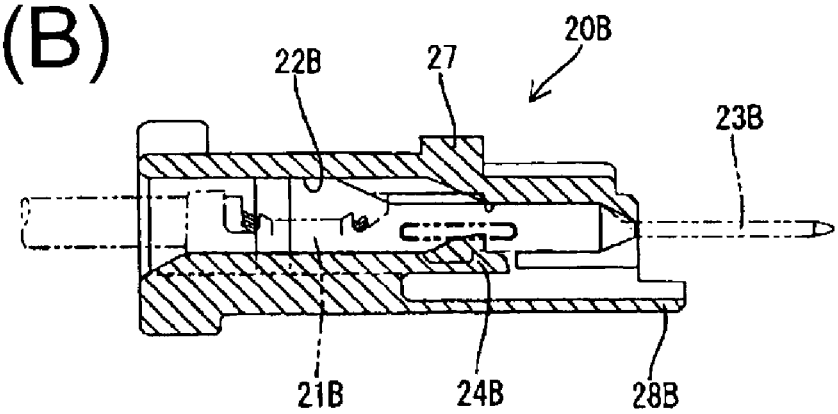
Figure 4C:
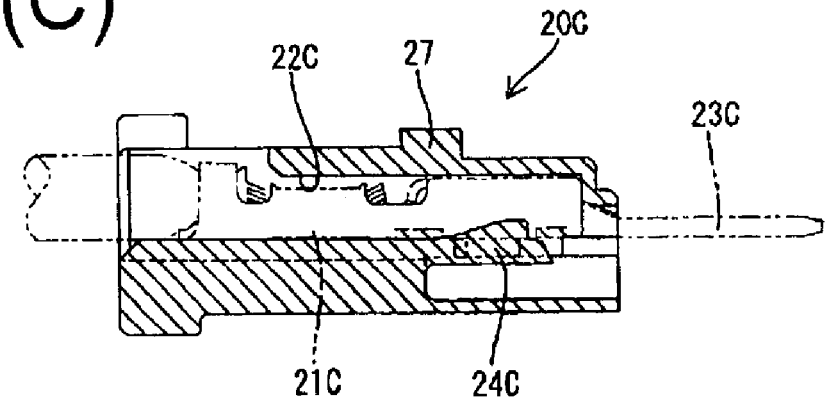
Figure 5A:
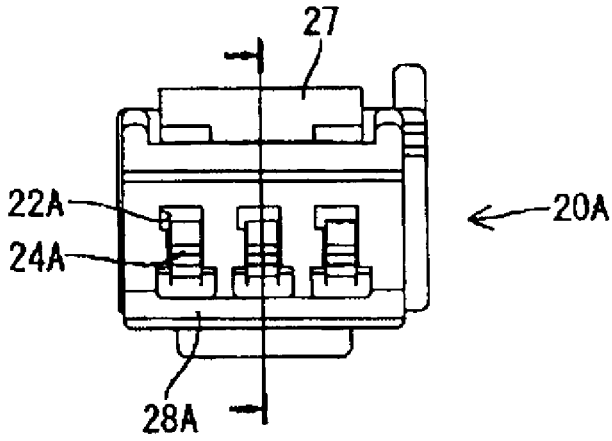
FIGS. 5(A), 5(B) and 5(C) are front views of the male housings.
Figure 5B:
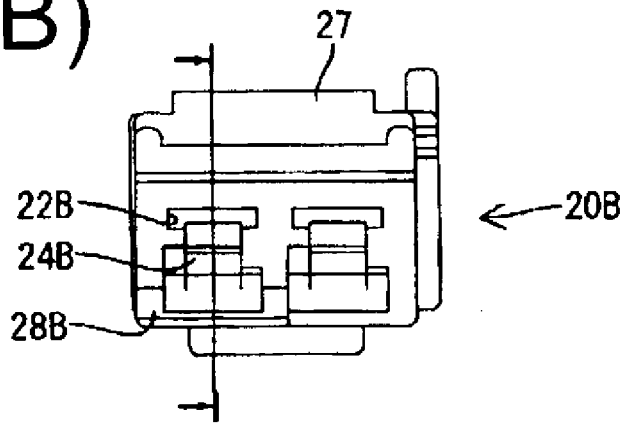
Figure 5C:
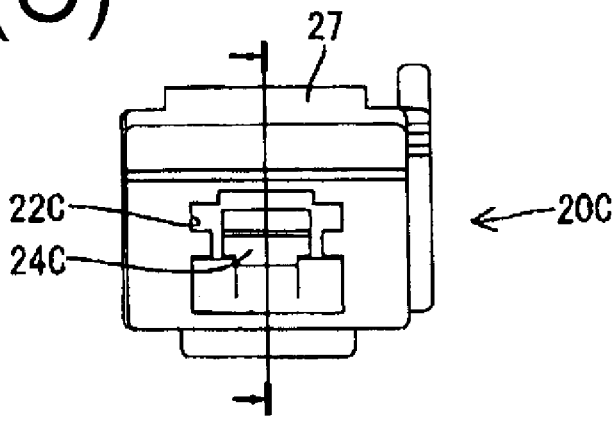

The male housings 20A, 20B, 20C are made e.g. of a synthetic resin and have similar rectangular parallelepipedic shapes, as shown in FIGS. 4 and 5. The shapes enable the male housings 20A, 20B, 20C to fit into desired accommodating chambers 11 of the male frame 10 from behind. However, the male housings 20A, 20B, 20C in the accommodating chambers 11 at the lower stage are inverted vertically. The kinds of the male housings 20A, 20B, 20C are sorted according to the sizes of terminal fittings to be mounted therein. Specifically, three small cavities 22A for small male terminals 21A are arranged substantially side by side along the widthwise direction in the male housing 20A. Two medium cavities 22B for medium male terminals 21B are arranged substantially side by side along the widthwise direction in the male housing 20B. Only one large cavity 22C for a large male terminal 21C is formed in the male housing 20C. The cavities 22A, 22B, 22C all open forward and backward. The male terminals 21A, 21B, 21C are insertable into the cavities 22A, 22B, 22C through the rear openings of the cavities 22A, 22B, 22C, and tabs 23A, 23B, 23C of the male terminals 21A, 21B, 21C project forward through the front openings of the cavities 22A, 22B, 22C. Locks 24A, 24B, 24C project from bottom surfaces of the respective cavities 22A, 22B, 22C near the front ends and are resiliently deformable up and down. The locks 24A, 24B, 24C are configured to lock the male terminals 21A, 21B, 21C in the respective cavities 22A, 22B, 22C. A retainer 26 is formed unitarily with the upper surface of the male housing 20A and can be opened and closed via a hinge 26A. Three projections 26B are formed on the lower surface of the retainer 26 for projecting into the respective small cavities 22A. The projections 26B engage the small male terminals 21A with the retainer 26 closed, as shown in FIG. 4(A), to lock the small male terminals 21A doubly.

A lock projection 27 projects unitarily up from substantially the widthwise middle of the upper surface of each male housing 20A, 20B, 20C near the front end. Insertion grooves 14 are formed in the ceiling surface of each upper accommodating chamber 11 and the bottom surface of each lower accommodating chamber 11. The insertion grooves 14 extend forward from the rear ends and are configured to receive the lock projection 27. Resilient locking pieces 15 are cantilevered from the upper and lower surfaces of the male frame 10 and are resiliently deformable up and down. The male housings 20A, 20B, 20C can be locked in the accommodating chambers 11 by engaging the lock projections 27 with locking claws 15A at the leading ends of the resilient locking pieces 15 in the insertion grooves 14.

The female split-type connector F has a female frame 30 with accommodating chambers 31, and three kinds of female housings 40A, 40B, 40C that can be accommodated in the accommodating chambers 31.

Figure 6:
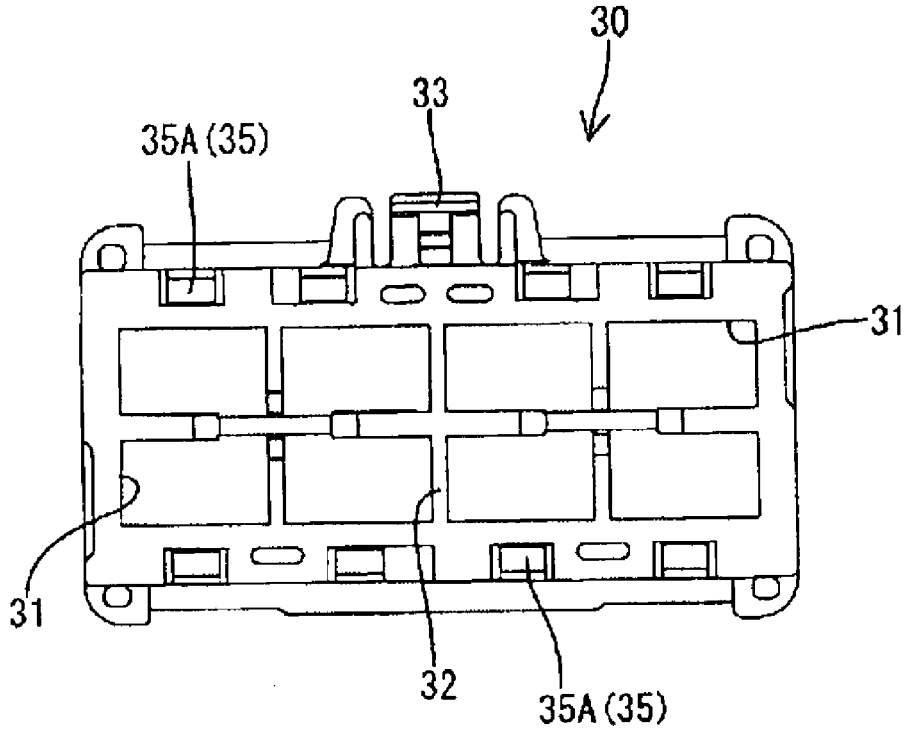
FIG. 6 is a front view of a female frame.
Figure 7:
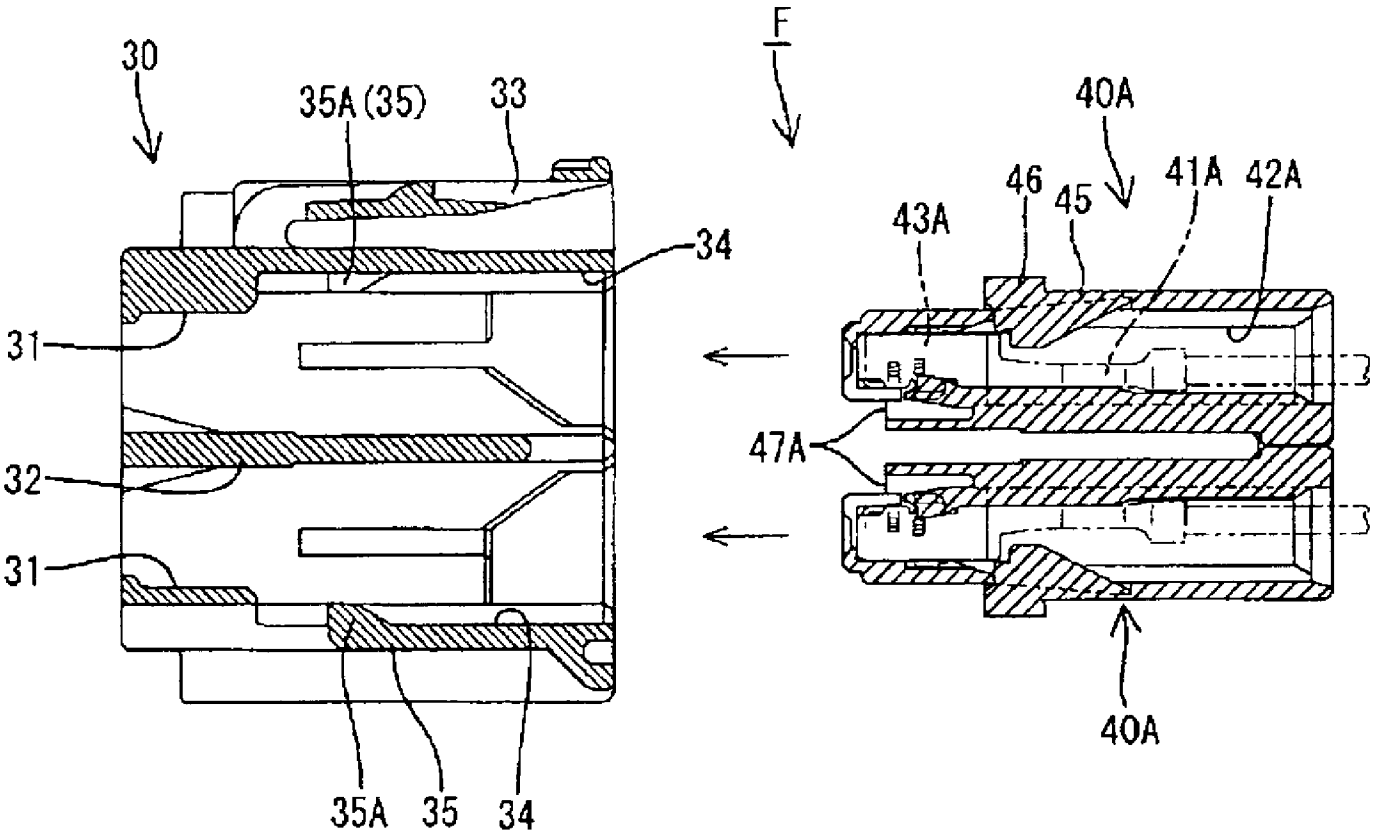
FIG. 7 is a side view in section of the female frame and a female housing.

The female frame 30 is made e.g. of a synthetic resin and is in the form of a wide box-shaped frame, as shown in FIGS. 6 and 7. Eight accommodating chambers 31 are formed in the female frame 30 and are partitioned by lattice-shaped partition walls 32. The accommodating chambers 31 are arranged in upper and lower stages, and hence define four substantially symmetrical vertical pairs of accommodating chambers 31. Each accommodating chamber 31 is substantially rectangular and opens forward and back. Most of the female frame 30 is fittable into the receptacle 12 of the male frame 10 from the front end. A cantilevered lock arm 33 is formed substantially in the middle of the upper surface of the female frame 30 and is resiliently deformable up and down. The lock arm 33 engages an engaging portion 17 on the ceiling surface of the receptacle 12 when the female and male frames 30, 10 are connected properly. Thus, the two frames 30, 10 are locked together.

Figure 8A:
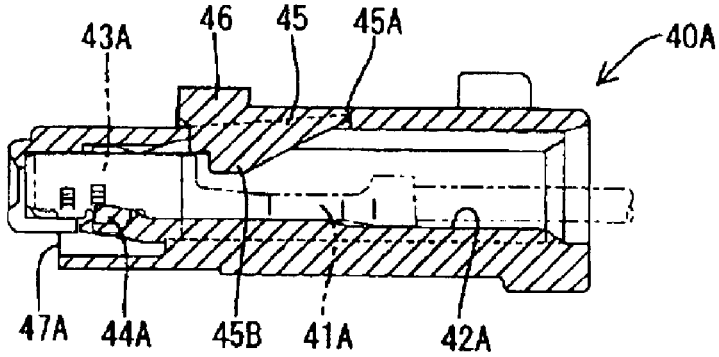
FIGS. 8(A), 8(B) and 8(C) are side views in section showing three kinds of female housings.
Figure 8B:
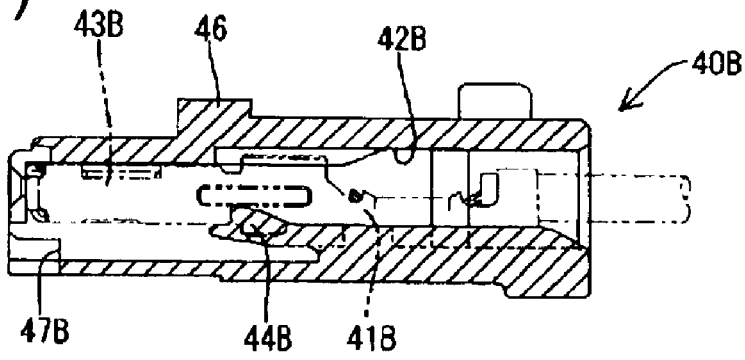
Figure 8C:
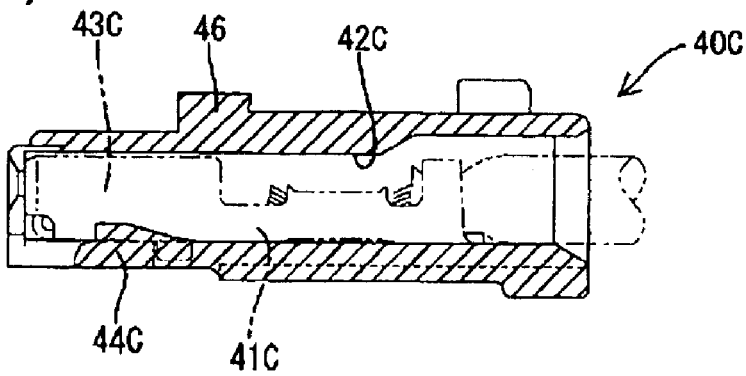
Figure 9A:
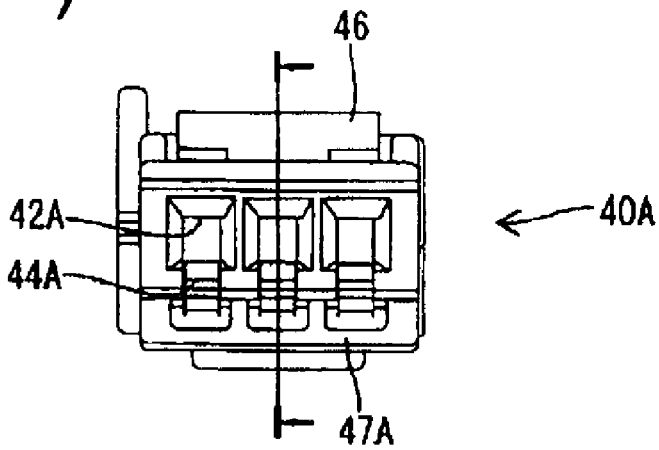
FIGS. 9(A), 9(B) and 9(C) are front views of the female housings.
Figure 9B:
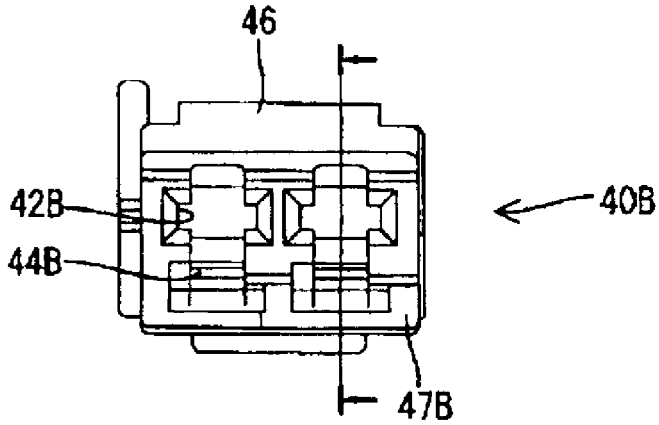
Figure 9C:
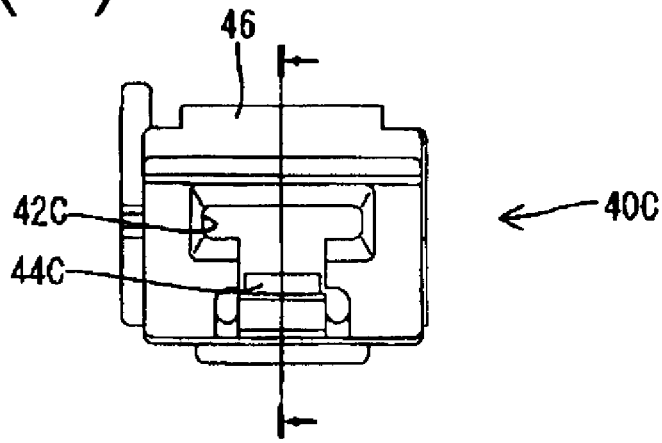
Figure 10A:
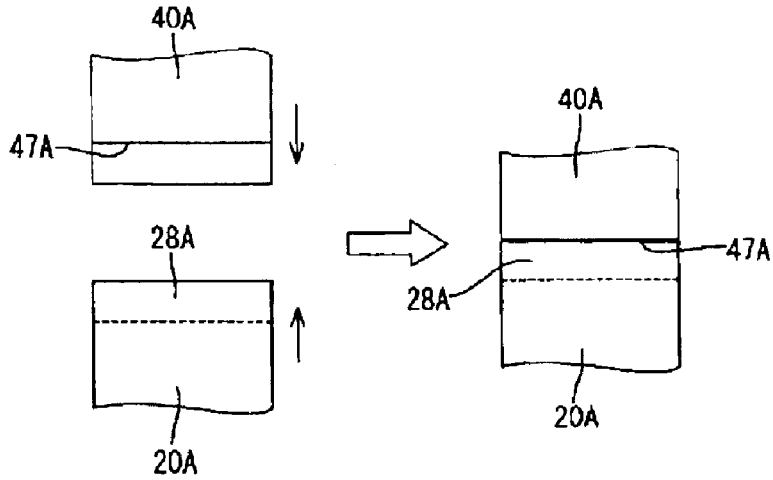
FIGS. 10(A), 10(B) and 10(C) are diagrams schematically showing constructions of error connection preventing means.
Figure 10B:
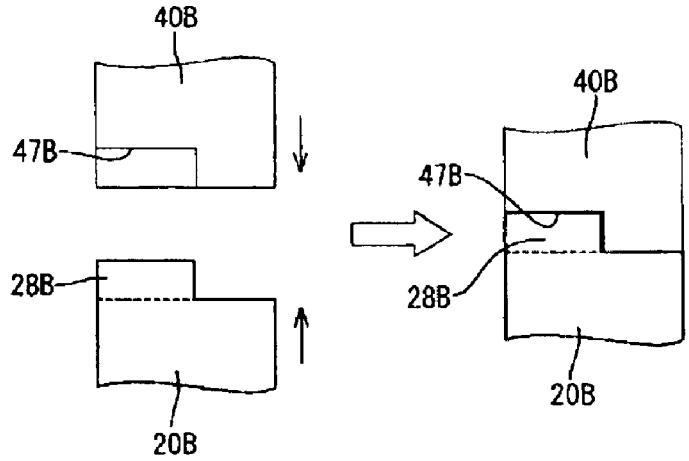
Figure 10C:
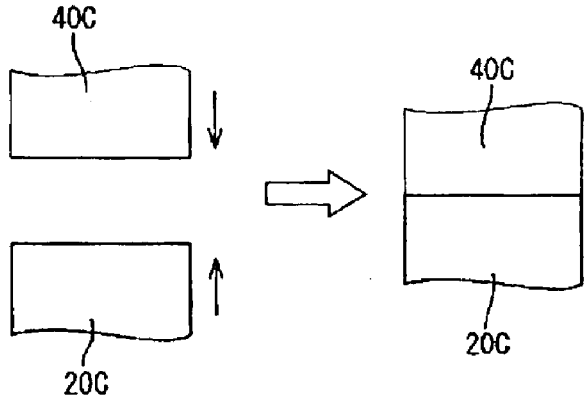

The female housings 40A, 40B, 40C are made e.g. of a synthetic resin and have substantially identical rectangular parallelepipedic shapes, as shown in FIGS. 8 and 9. The shapes enable the female housings 40A, 40B, 40C to fit into desired accommodating chambers 31 of the female frame 30 from behind. However, the female housings 40A, 40B, 40C in the accommodating chambers 31 at the lower stage are inverted vertically. The kinds of female housings 40A, 40B, 40C are sorted according to the sizes of terminal fittings to be mounted therein. Specifically, three small cavities 42A for small female terminals 41A are arranged side by side along the widthwise direction in the female housing 40A. Two medium cavities 42B for medium female terminals 41B are arranged side by side along the widthwise direction in the female housing 40B. Only one large cavity/cavity 42C for a large female terminal 41C is formed in the female housing 40C. The small female terminals 41A, the middle female terminals 41B and the large female terminals 41C correspond to the small male terminals 21A, the middle male terminals 21B and the large male terminals 21C, respectively, and the female housings 40A, 40B, 40C correspond to the male housings 20A, 20B, 20C, respectively. The respective cavities 42A, 42B, 42C are open forward and backward, and the female terminals 41A, 41B, 41C are insertable therein through the rear openings of the cavities 42A, 42B, 42C. The tabs 23A, 23B, 23C of the male terminals 21A, 21B, 21C are introduced through the front openings of the respective cavities 42A, 42B, 42C and are inserted into substantially box-shaped terminal connecting portions 43A, 43B, 43C of the female terminals 41A, 41B, 41 C to connect the male and female terminals electrically.

Locks 44A, 44B, 44C are formed near front ends of the bottom surfaces of the respective cavities 42A, 42B, 42C, and are resiliently deformable up and down for locking the female terminals 41A, 41B, 41C. The upper surface of the male housing 40A is formed unitarily with a retainer 45 that can be opened and closed via a hinge 45A. Three projections 45B are formed on the lower surface of the retainer 45. The projections 45B project into the respective small cavities 42A to engage and doubly lock the small female terminals 41A when the retainer 45 is closed, as shown in FIG. 8(A).

A lock projection 46 is formed substantially at a widthwise middle position of-the upper surface of each female housing 40A, 40B, 40C near the front end. The lock projection 46 of the female housing 40A is formed unitarily on the upper surface of the retainer 45. Insertion grooves 34 extend forward from the rear ends of the ceiling surface of each upper accommodating chamber 31 and the bottom surface of each lower accommodating chamber 31. The lock projection 46 is insertable into the corresponding insertion groove 34. Locking pieces 35 are cantilevered from the upper and lower surfaces of the female frame 30 and are resiliently deformable up and down. Locking claws 35A project into the insertion grooves 34 from the leading ends of the resilient locking pieces 35. The locking claws 35A engage the lock projections 46 to lock the female housings 40A, 40B, 40C in the accommodating chambers 31.

An error connection preventing projection 28A extends forward from the front bottom end of each male housing 20A and is formed substantially over the entire width of the male housing 20A. On the other hand, a receiving portion 47A is formed over substantially the entire width at the bottom of the front surface of the corresponding female housing 40A. As shown schematically in FIG. 10(A), the error connection preventing projection 28A is received in the receiving portion 47A when the front surfaces of the male and female housings 20A, 40A are brought substantially into abutment against each other.

An error connection preventing projection 28B extends forward from the front bottom end of each male housing 20B and is formed in a left half area when the male housing 20B is viewed from thee front. On the other hand, a receiving portion 47B is formed by recessing a right half of the bottom of the front surface of the corresponding female housing 40B. As shown schematically in FIG. 10(B), the error connection preventing projection 28B is received in the receiving portion 47B when the front surfaces of the male and female housings 20B, 40B are brought substantially into abutment against each other.

Each male housing 20C and each female housing 40C have neither an error connecting preventing projection nor a receiving portion. Thus, the male housings 20A, 20B, 20C and the female housings 40A, 40B, 40C have differently shaped front surfaces including the error connection preventing projections 28A, 28B and the receiving portions 47A, 47B depending on their kinds.

The kinds and numbers of the housings to be used in the male and female frames 10, 30 and the positions of the accommodating chambers corresponding to the housings are determined in accordance with a circuit construction and the like. Each male housing 20A, 20B, 20C is fit into the corresponding accommodating chamber 11 of the male frame 10 so that the lock projection 27 enters the insertion groove 14. The resilient locking piece 15 engages the lock projection 27 from behind as the male housing 20A, 20B, 20C reaches a proper position, thereby locking the male housing 20A, 20B, 20C so as not to come out. Likewise, each female housing 40A, 40B, 40C is fit into the corresponding accommodating chamber 31 of the female frame 30 so that the lock projection 46 enters the insertion groove 34. As a result, the resilient locking piece 35 engages the lock projection 46, thereby locking the female housing 40A, 40B, 40C so as not to come out.

Figure 11:
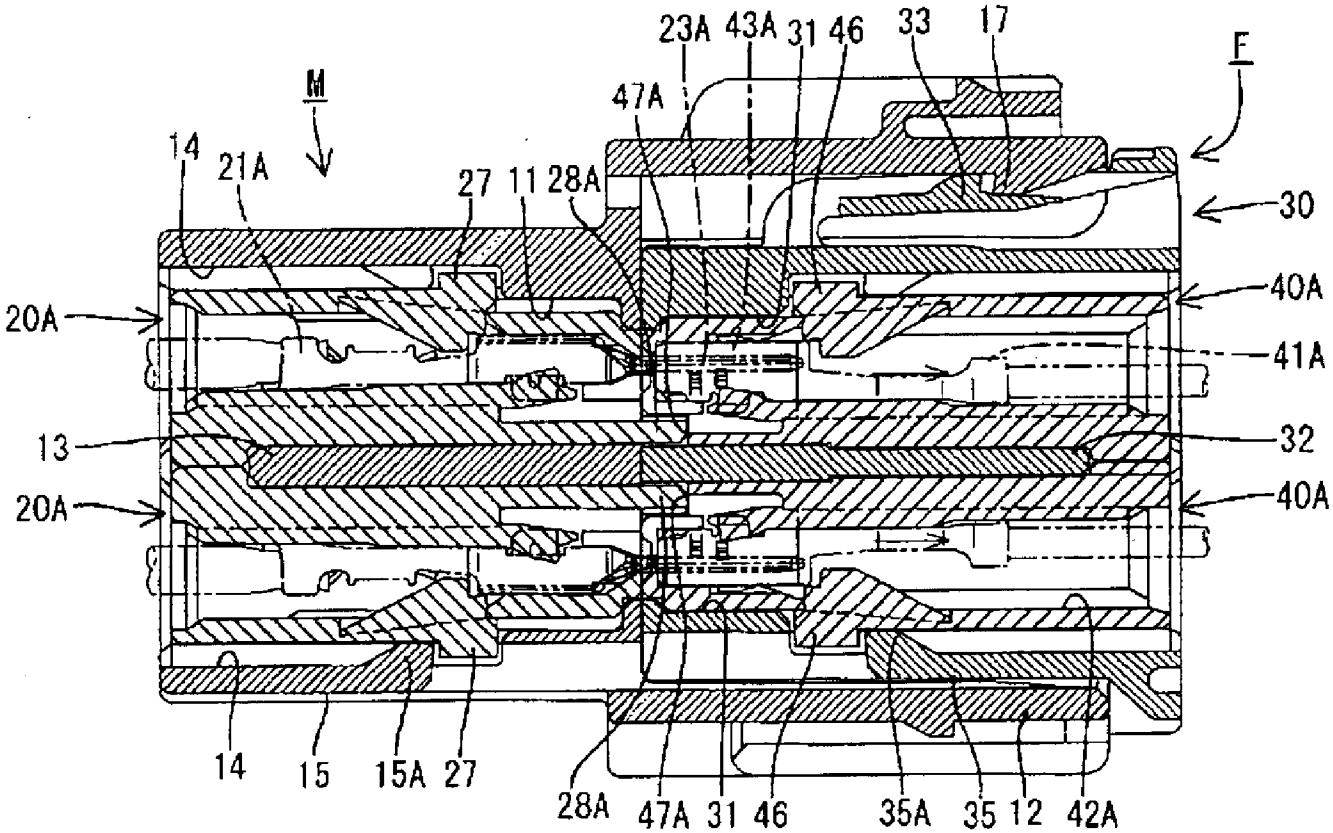
FIG. 11 is a side view in section showing a state where the male and female split-type connectors are properly connected.

The male split-type connector M and the female split-type connector F are connected by fitting the female frame 30 of the female split-type connector F into the receptacle 12 as indicated by an arrow in FIG. 1. As a result, the tabs 23A, 23B, 23C that project from the respective male housings 20A, 20B, 20C enter the cavities 42A, 42B, 42C of the female housings 40A, 40B, 40C opposed to the tabs 23A, 23B, 23C and then enter the terminal connecting portions 43A, 43B, 43C of the female terminals 41A, 41B, 41C in the cavities 42A, 42B, 42C. The front end surface of the female frame 30 substantially abuts the back wall of the receptacle 12 when the two connectors M, F reach a proper connection position. Additionally, the front surfaces of the respective male housings 20A, 20B, 20C substantially abut the front surfaces of the female housings 40A, 40B, 40C opposed thereto, and the error connection preventing projections 28A, 28B are received in the corresponding receiving portions 47A, 47B of the female housings 40A, 40B as shown in FIG. 11.

Figure 12A:
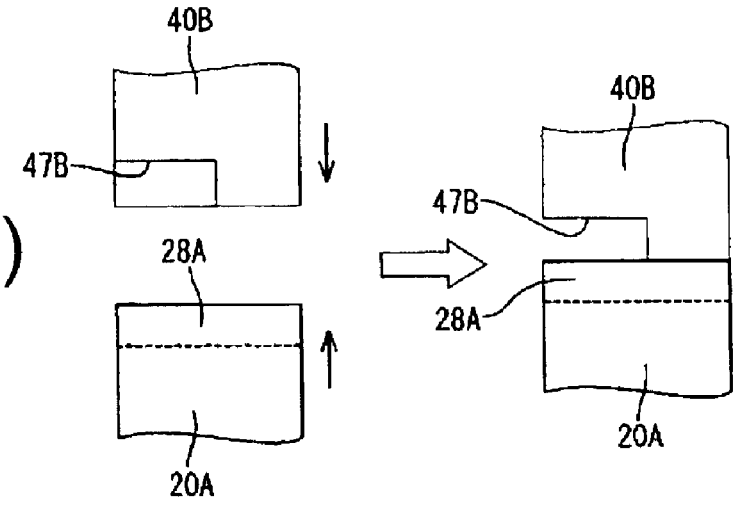
FIGS. 12(A) and 12(B) schematically show a state where error connection preventing projections interfere with the mating housings.
Figure 13:
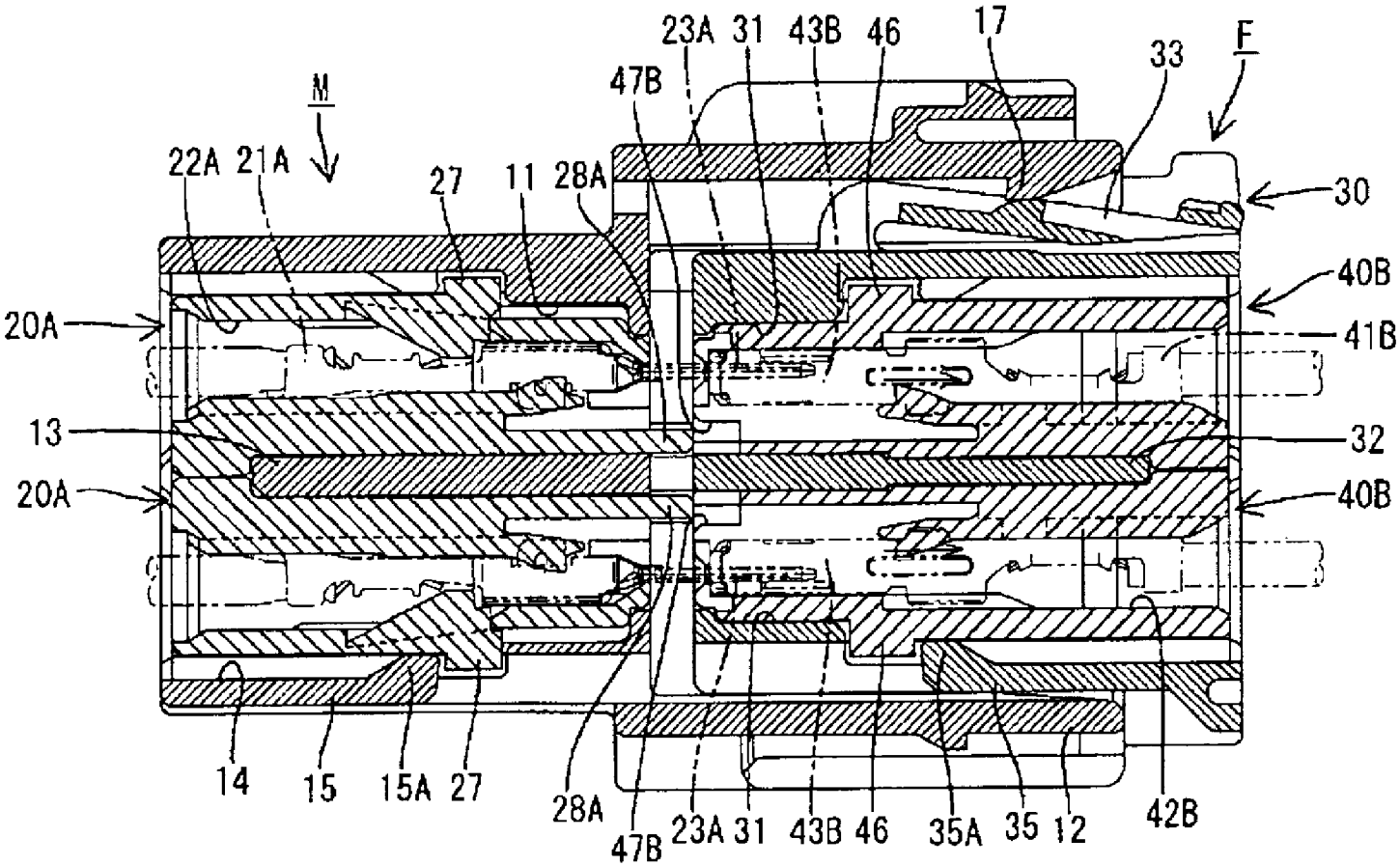
FIG. 13 is a side view in section showing a state where the connection of the male and female split-type connectors is hindered.
Figure 14:
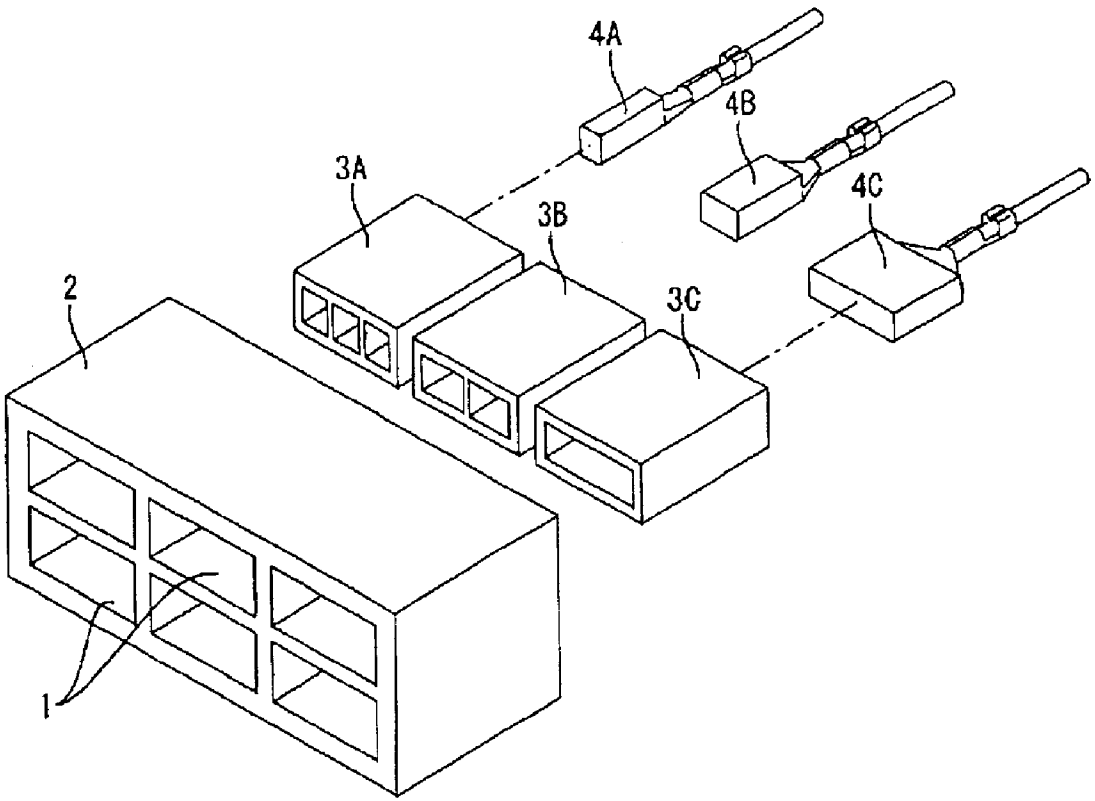
FIG. 14 PRIOR ART
FIG. 14 is a plan view of a prior art split-type connector.

An operator may mistakenly choose the kinds and positions of the housings accommodated in the frames 10, 30 while assembling the two connectors F, M. For example, the female housing 40B could be mounted in the accommodating chamber 31 at a position opposed to the male housing 20A. Thus, the leading end of the error connection preventing projection 28A abuts the front surface of the female housing 40B, as shown in FIGS. 12(A) and 13, and further connection of the connectors M, F is prevented. The operator will notice the mounting error because the two connectors M, F cannot reach the proper connection position.

Figure 12B:
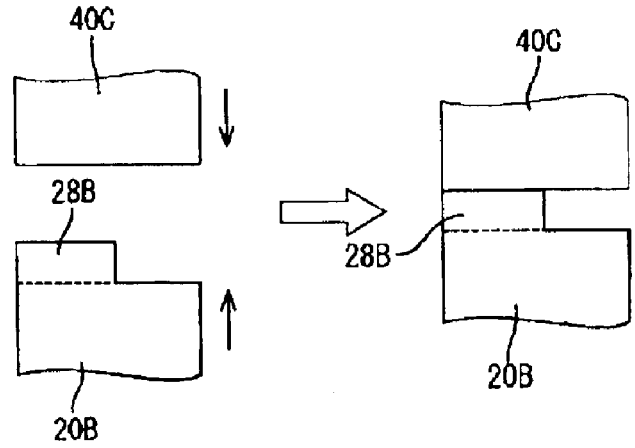

Similarly, the female housing 40C could be mounted in the accommodating chamber 31 at a position opposed to the male housing 20B. Thus, the leading end of the error connection preventing projection 28B abuts the front surface of the female housing 40C, as shown in FIG. 12(B), and further connection of the male and female connectors F, M is prevented. The female housing 40C could be mounted in the accommodating chamber 31 at a position opposed to the male housing 20A. Thus, the leading end of the error connection preventing projection 28A abuts the front surface of the female housing 40C, and further connection of the male and female connectors F, M is prevented.

The tabs 23B, 23C of the male terminals 21B, 21C will contact the opening edges of the mating cavities 42A, 42B during the connection if the female housing 40A is mounted at a position opposed to the male housing 20B or if the female housing 40A or 40B is mounted at a position opposed to the male housing 20C. Thus, the proper connection of the two connectors M, F is hindered in this case as well.

As described above, the error connection preventing means between the male housings 20A, 20B, 20C and the female housings 40A, 40B, 40C prevents the two connectors M, F from being connected with a wrong correspondence of the male and female housings.

The error connection preventing means include the error connection preventing projections 28A, 28B on the male housings 20A, 20B and the receiving portions 47A, 47B in the female housings 40A, 40B. The error connection preventing projections 28A, 28B of the male housings 20A, 20B are received into the receiving portions 47A, 47B of the female housings 40A, 40B to connect the two connectors M, F properly if the combination of the housings is correct in the male and female connectors M, F. However, the error connection preventing projections 28A, 28B on the male housings 20A, 20B interfere with the female housings 40B, 40C opposed thereto, if the combination of the housings is wrong in the male and female connectors M, F, thereby hindering the proper connection of the two connectors F, M.

The kinds of the housings are sorted according to the sizes of the terminal fittings. Thus, an undesirable event where the tabs 23A, 23B of the smaller male terminals 21A, 21B are inserted into the larger female terminals 41B, 41C to connect the two connectors M, F up to the proper connection position can be prevented when an attempt is made to connect the two connectors M, F in a wrong correspondence of the male and female housings.

Figure 15:
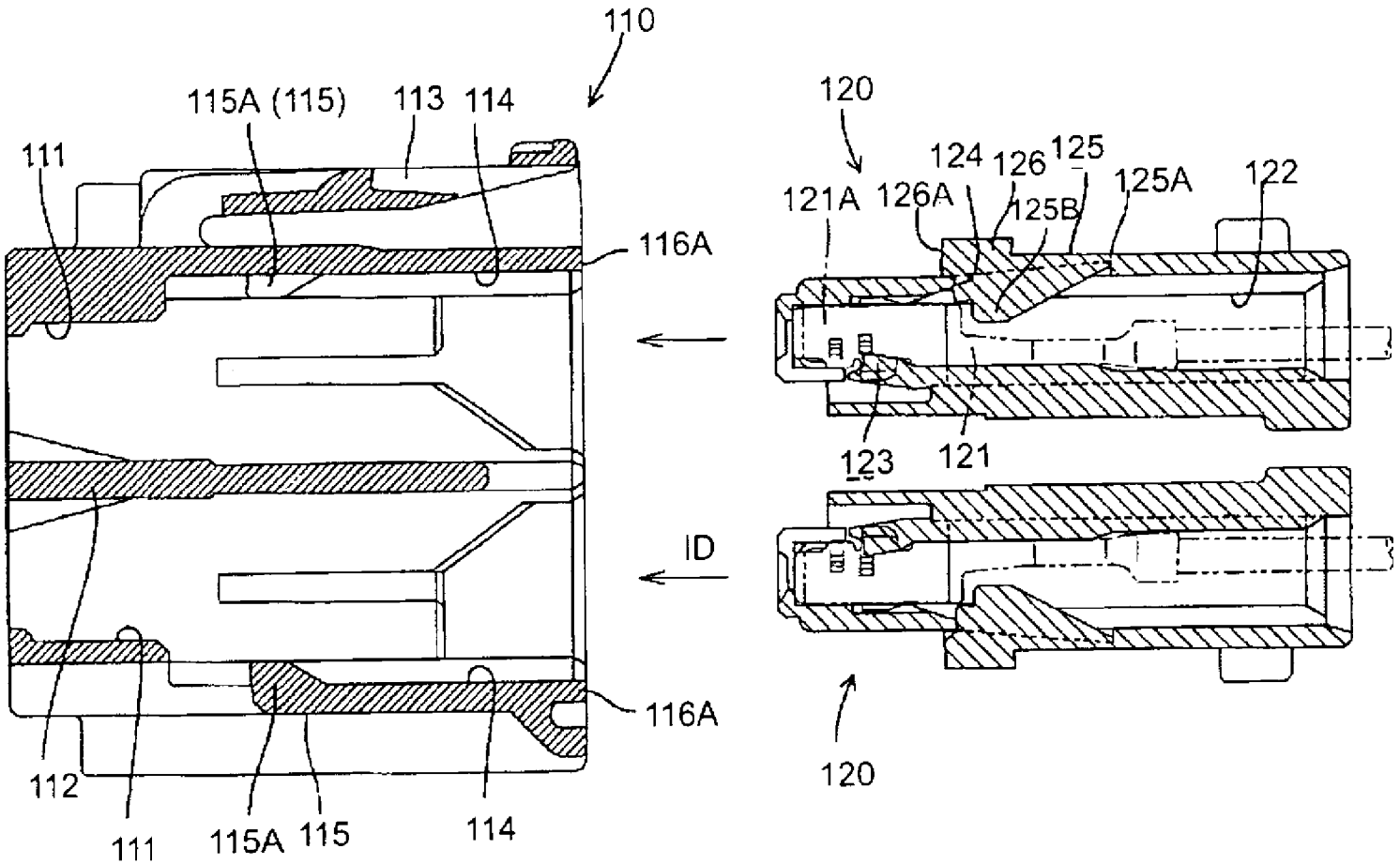
FIG. 15 is an exploded side view in section of a split-type connector according to one further preferred embodiment of the invention.

A split-type connector according to a second embodiment of the invention is described with reference to FIGS. 15 to 24. The split-type connector of this embodiment is a female connector comprised of a frame 110 formed with a plurality of accommodating chambers 111, and auxiliary housings 120 that can be accommodated in the respective accommodating chambers 111, as shown in FIG. 15. A mating connector (not shown) is connectable with this connector from the front (left in FIG. 15).

Figure 16:
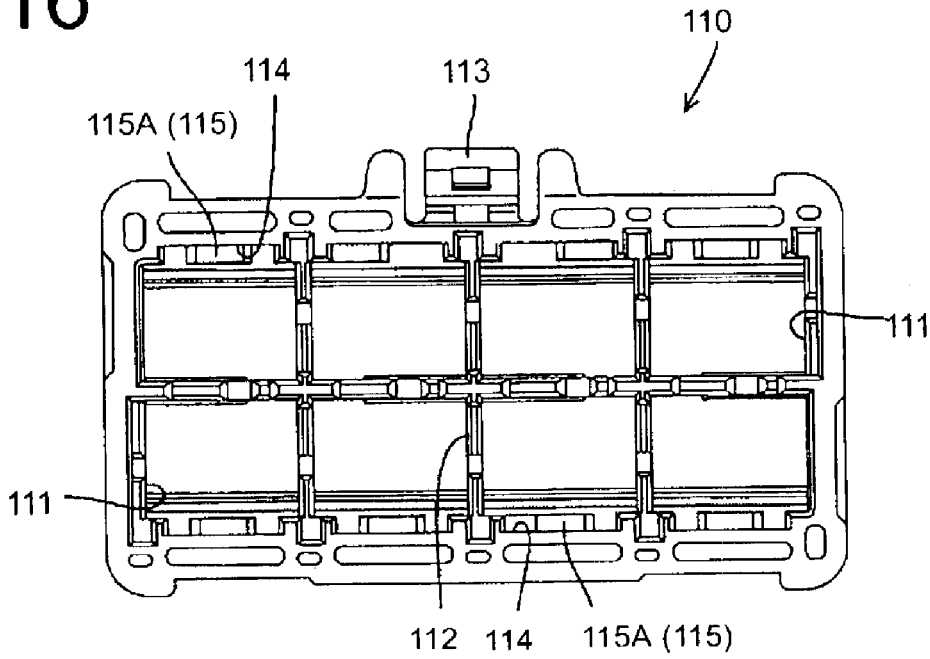
FIG. 16 is a rear view of a frame.
Figure 17:
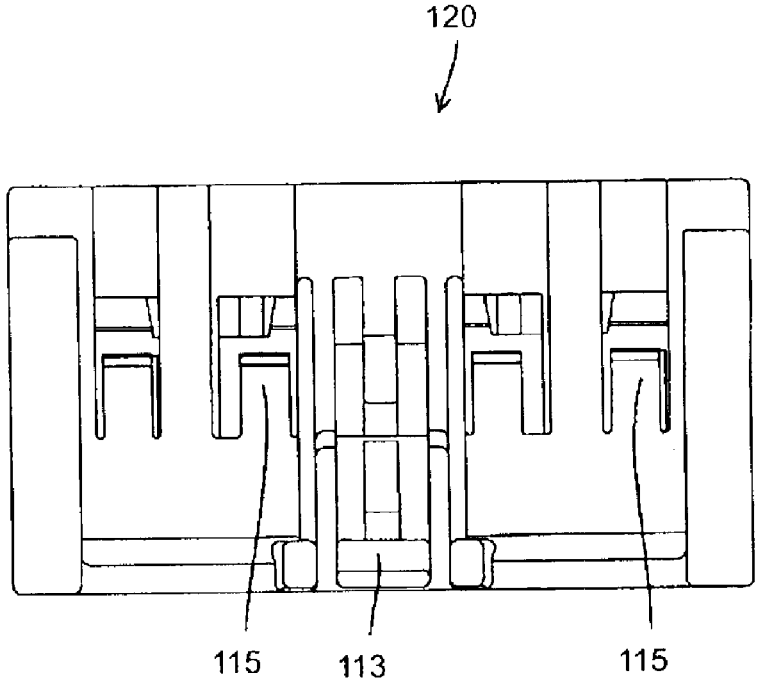
FIG. 17 is a plan view of the frame.

The frame 110 is made e.g. of a synthetic resin, and is a wide rectangle, as shown in FIGS. 15 to 17. Eight accommodating chambers 111 are formed in the frame 110 and are partitioned by lattice-shaped partition walls 112. The accommodating chambers 111 are arranged in upper and lower stages, and hence define four substantially symmetrical vertical pairs of accommodating chambers 111. Each accommodating chamber 111 is substantially rectangular and opens forward and back. A cantilevered lock arm 113 is formed substantially in the middle of the upper surface of the frame 110 and is resiliently deformable up and down. The lock arm 113 engages the male connector to lock the male and female connectors together.

Figure 18:
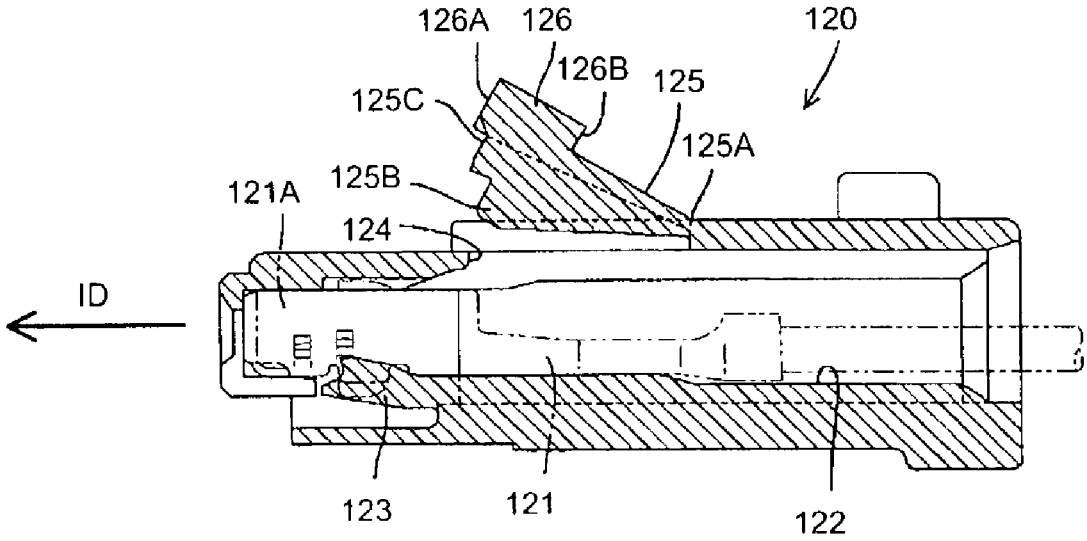
FIG. 18 is a side view in section of an auxiliary housing with a retainer held at an exposing position.
Figure 19:
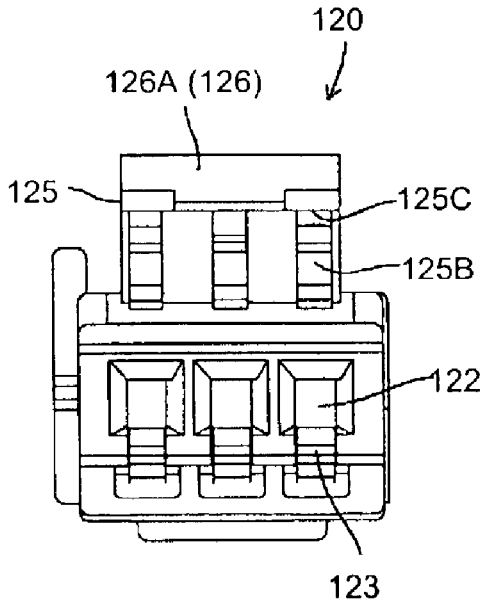
FIG. 19 is a front view of the auxiliary housing with the retainer held at the exposing position.
Figure 20:
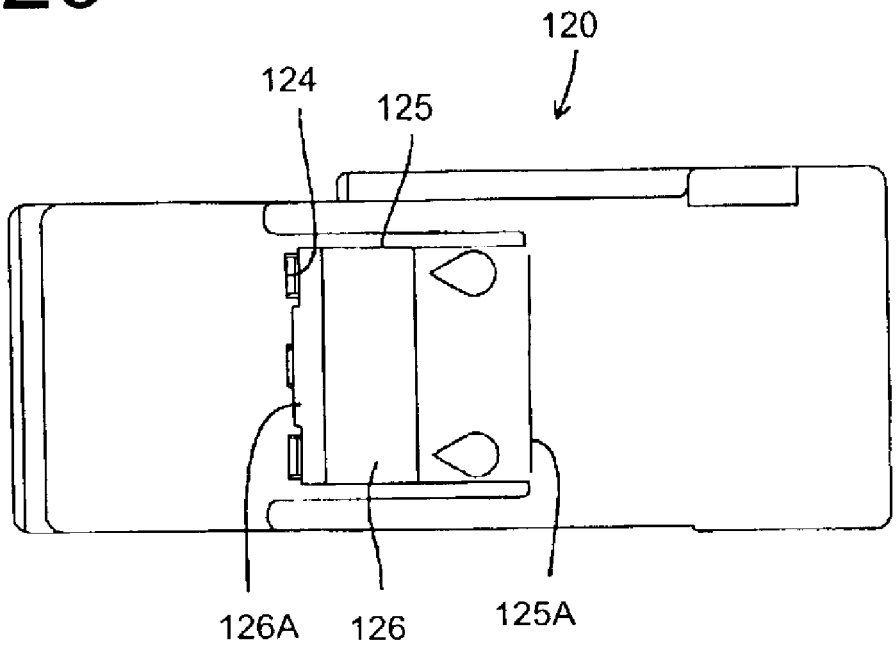
FIG. 20 is plan view of the auxiliary housing with the retainer held at the exposing position.

The auxiliary housings 120 are made e.g. of a synthetic resin and define substantially rectangular parallelepipedic shapes. Each auxiliary housing 120 is dimensioned to fit from behind into the accommodating chambers 111 of the frame 110, as shown in FIGS. 18 to 20. The auxiliary housings 120 in the accommodating chambers 111 at the lower stage are inverted vertically. Three cavities 122 are formed side by side along the widthwise direction in each auxiliary housing 120. The cavities 122 open forward and backward, and female terminal fittings 121 are insertable into the cavities 122 through the rear openings. A lock 123 is formed near the front end of the bottom surface of each cavity 122 and is resiliently deformable up and down. Thus, the lock 123 is engageable with the bottom surface of a substantially box-shaped terminal connecting portion 121A of the female terminal fitting 121.

A substantially rectangular retainer mount hole 124 is formed near a middle position of the upper surface of each auxiliary housing 120 with respect to forward and backward directions and communicates with the respective cavities 122. A thin hinge 125A is provided on the rear edge of the retainer mount hole 124, and a retainer 125 is provided unitarily at the auxiliary housing 120 via the hinge 125A. The retainer 125 is substantially in the form of a plate, and can be opened and closed between an exposing position (see FIGS. 18 to 20) and a closing position (see FIG. 15) by resiliently deforming the hinge 125A to pivot the retainer 125. The retainer mount hole 124 is exposed when the retainer 125 is in the exposing position, but is closed when the retainer is in the closing position. Three fastening projections 125B project from the lower surface of the retainer 125 and correspond to the respective cavities 122. The projecting distance of the fastening projections 125B increases toward their front ends. The fastening positions 125 project into the corresponding cavities 122 when the retainer 125 is in the closing position and engage the rear ends of the terminal connecting portions 121A of the female terminal fittings 121 to lock the female terminal fittings 121. However, the fastening projections 125B are retracted above the cavities 122 when the retainer 125 is in the exposing position to permit insertion and withdrawal of the female terminal fittings 121 into the respective cavities 122. A locking recess 125C in the form of a transverse groove is formed at the front end of each fastening projection 125B, and the retainer 125 is held at the closing position by fitting the front edge of the retainer mount hole 124 into the locking recesses 125C.

A lock projection 126 is formed unitarily at the front end of the upper surface of the retainer 125 and extends over substantially the entire width of the retainer 125. The lock projection 126 is substantially in the form of a rectangular parallelepiped and has a front surface 126A that extends substantially normal to an inserting direction ID of the auxiliary housing 120 into the accommodating chamber 111 when the retainer 125 is at the closing position. Further, a rear surface 126B of the lock projection 126 is negatively sloped and inclines slightly back toward its leading end when the retainer 125 is at the closing position.

Insertion grooves 114 extend forward from the rear ends of the ceiling surface of each upper accommodating chamber 111 and the bottom surface of each lower accommodating chamber 111 and receive the lock projection 126. Resilient locking pieces 115 are cantilevered forwardly from the upper and lower surfaces of the frame 110 and are resiliently deformable up and down. A locking claw 115A is formed at the leading end of each resilient locking piece 115 and projects into the insertion groove 114. The front surface of each locking claw 115A is sloped negatively to incline slightly forward toward its leading end. The auxiliary housing 120 is held in the accommodating chamber 111 by the engagement of the rear surface 126B of the lock projection 126 with the front surface of the locking claw 115A. The opening edge of the accommodating chamber 111 is almost entirely slanted for guiding purpose except an opening edge 116A of the insertion groove 114 which is not slanted.

The retainer 125 and the lock projection 126 are exposed in the auxiliary housing 120 with respect to forward and backward directions when the retainer 125 is at the exposing position, as shown in FIG. 18. Thus, the retainer 125 and the lock projection 126 can be molded unitarily with a main part of the auxiliary housing 120 by molds that can be opened and closed along forward and backward directions.

The split-type connector of this embodiment is assembled by holding the retainer 125 at the exposing position. The female terminal fitting 121 then is inserted from behind into each cavity 122. As a result, the terminal connecting portion 121A of the female terminal fitting 121 contacts the front end of the lock 123 and deforms the lock 123 down. The lock 123 returns resiliently to engage the bottom wall of the terminal connecting portion 121A when the female terminal fitting 121 is inserted to a proper position.

The retainer 125 then is pivoted about the hinge 125A and pushed to the closed position. As a result, the retainer 125 is deformed forward and back so that the locking recesses 125C engages the front edge of the retainer mount hole 124 (see FIG. 15). In this way, the fastening projections 125B engage the rear edges of the terminal connecting portions 121A to doubly lock the female terminal fittings 121. The female terminal fitting 121 might be inserted sufficiently. Thus, the fastening projection 125B abuts the upper surface of the corresponding terminal connecting portion 121A, and the retainer 125 cannot reach the closing position.

Each auxiliary housing 120 has the female terminal fittings 121 mounted therein. The auxiliary housing 120 then is inserted from behind and along the inserting direction ID into the accommodating chamber 111 of the frame 110, as indicated by an arrow of FIG. 15. The lock projection 126 then is inserted into the insertion groove 114 and the front surface 126A of the lock projection 126 contacts the locking claw 115A of the resilient locking piece 115 and deforms the resilient locking piece 115 up. The resilient locking piece 115 returns down when the auxiliary housing 120 is inserted to a proper position. Thus, the front surface of the locking claw 115A engages the corresponding rear surface 126B of the lock projection 126 (see upper auxiliary housing 20 of FIG. 21). In this way, the auxiliary housing 120 is held in the frame 110 and will not come out. The front surface of the locking claw 115A and the rear surface 126B of the lock projection 126 both are sloped negatively to hold the auxiliary housing 120 with an enhanced force.

Figure 23:
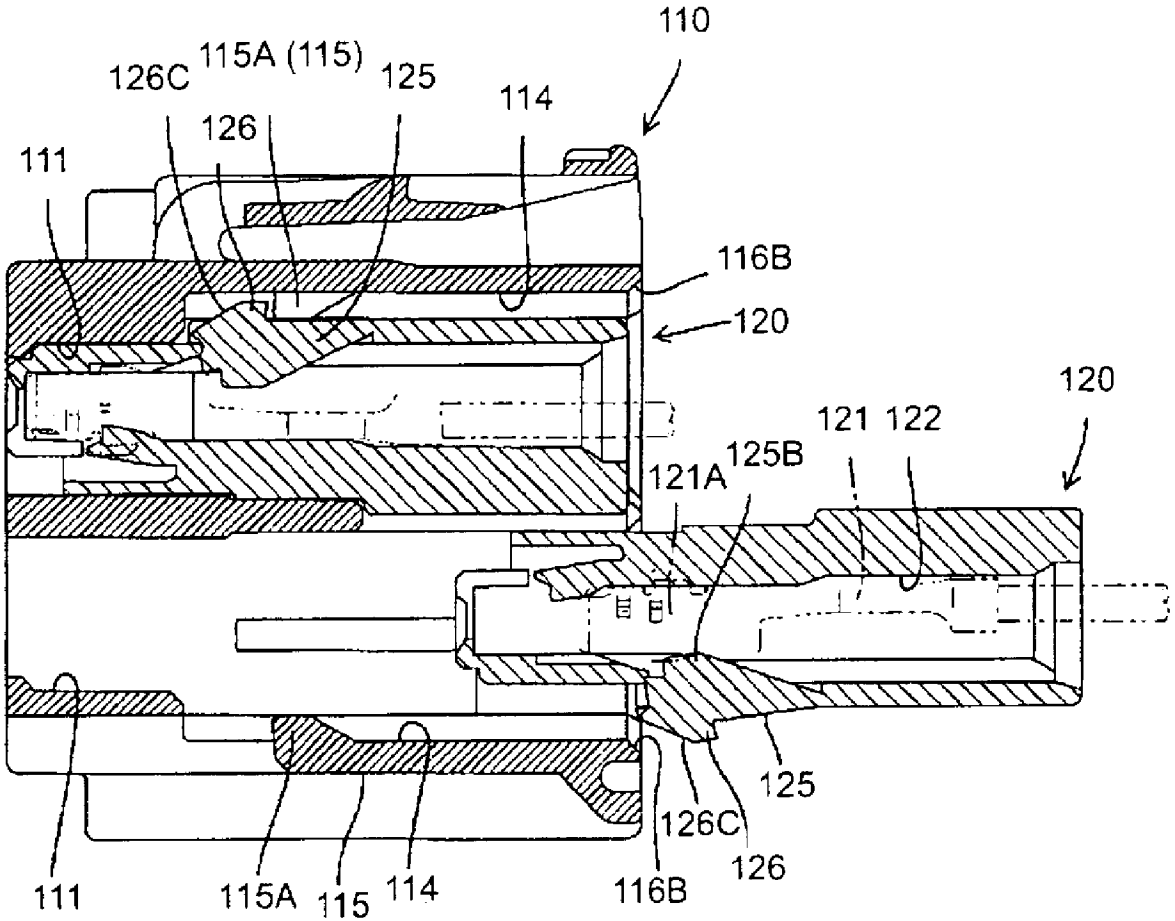
FIG. 23 is a side view in section showing a terminal fitting is left insufficiently inserted in a comparative example.
Figure 24:
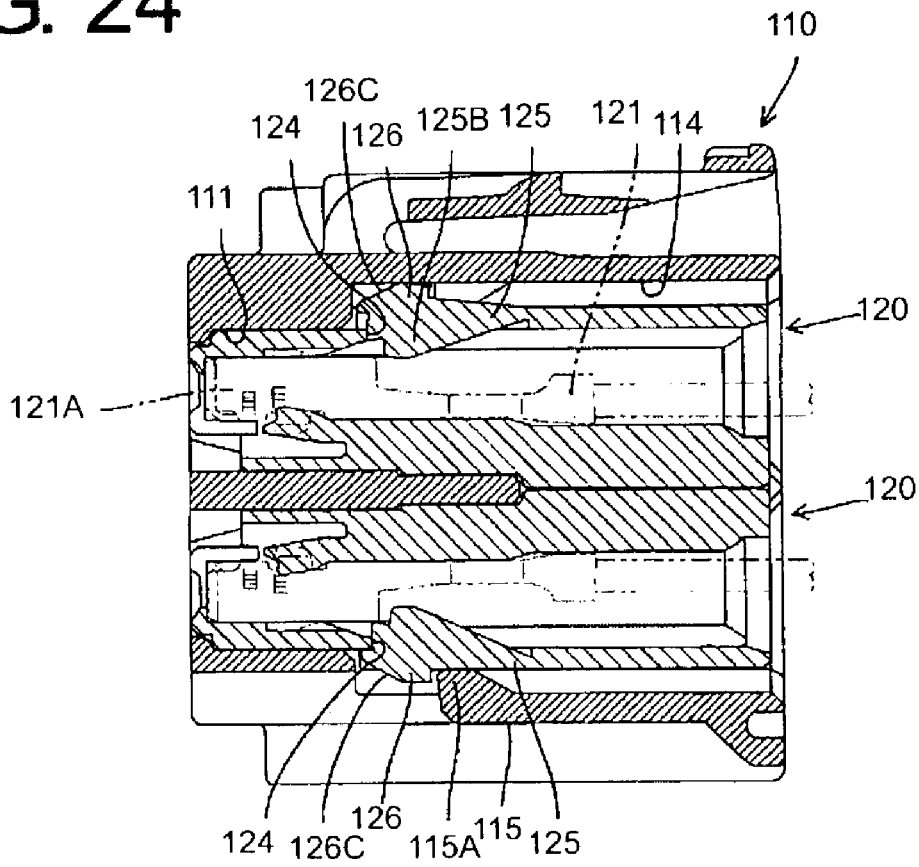
FIG. 24 is a side view in section showing a state where a retainer undergoes an opening deformation in the comparative example.

The connector shown in FIGS. 23 and 24 provides a comparative example. In this connector, a front surface 126C of a lock projection 126 is sloped positively and inclines back toward its leading end. Further, a slanted surface 116B is formed at the opening edge of the accommodating chamber 111 (insertion groove 114) for guiding the auxiliary housing 120. Other elements are the same as in the previous embodiment, and are identified by the same reference numerals.

A female terminal fitting 121 may be inserted insufficiently. An operator may try to fit an auxiliary housing 120 into an accommodating chamber 111 without noticing the insufficiently inserted state of the female terminal fitting 121 because a retainer 125 is at an intermediate position between an exposing position and a closing position. In such a case, the positively sloped front surface 126C of the lock projection 126 and the positively sloped surface 116B at the opening edge of the accommodating chamber 111 contact, as shown in FIG. 23 in the comparative example. Thus, if the auxiliary housing 120 is pushed strongly, a portion thereof including the retainer 125 may be slipped into the accommodating portion 111 and the auxiliary housing 120 may be inserted to a proper position.

Figure 21:
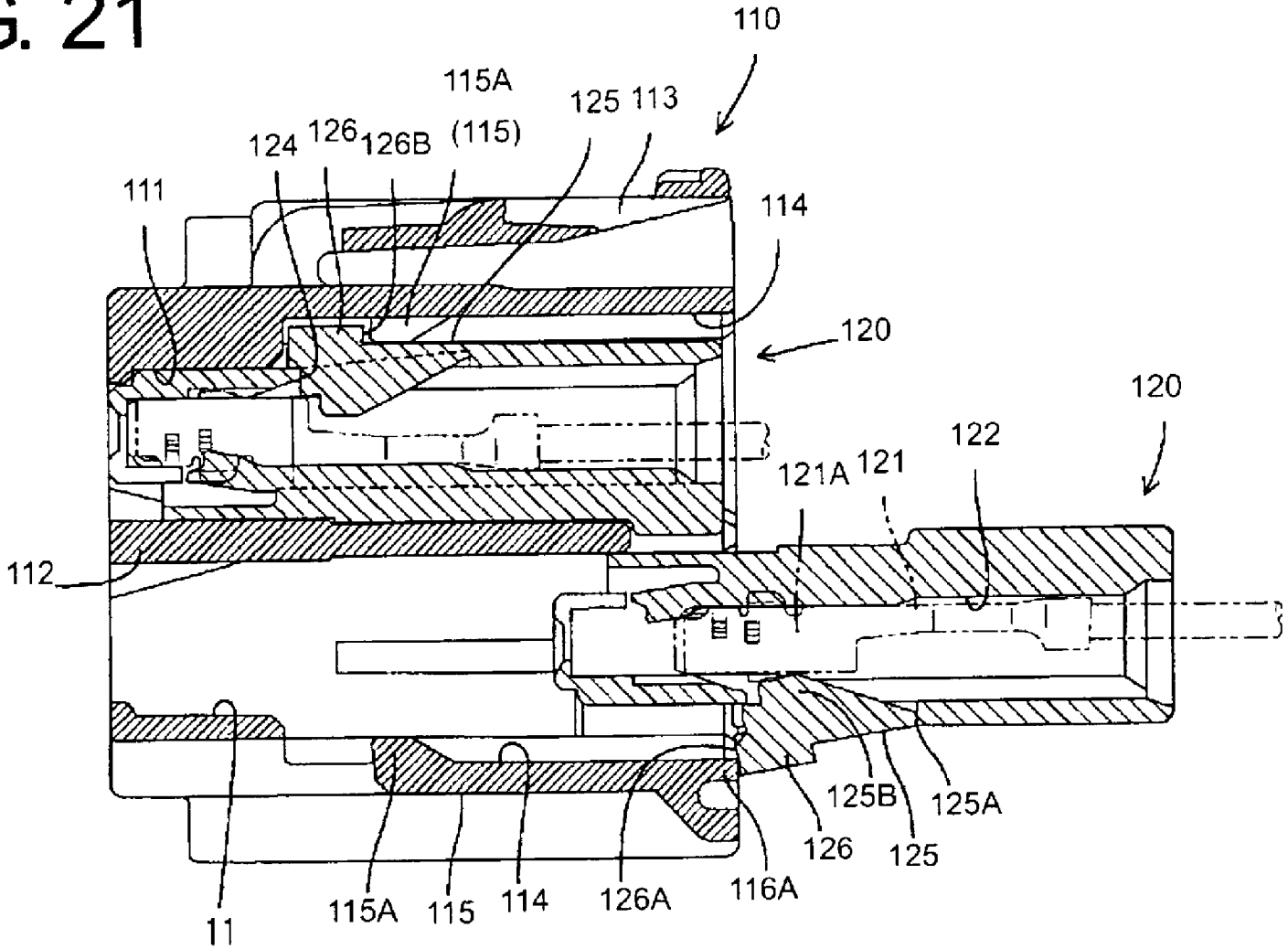
FIG. 21 is a side view in section showing a state where the insertion of the auxiliary housing is hindered.

Contrary to this the front surface 126A of the lock projection 126 abuts the opening edge 116A of the accommodating chamber 111, as shown in FIG. 21, and prevents insertion of the auxiliary housing 120 when an attempt is made to fit the auxiliary housing 120 into the accommodating chamber 111 while the female terminal fitting 122 is left insufficiently inserted. Thus, the auxiliary housing 120 cannot be assembled when the female terminal fitting 121 is inserted insufficiently.

Figure 22:
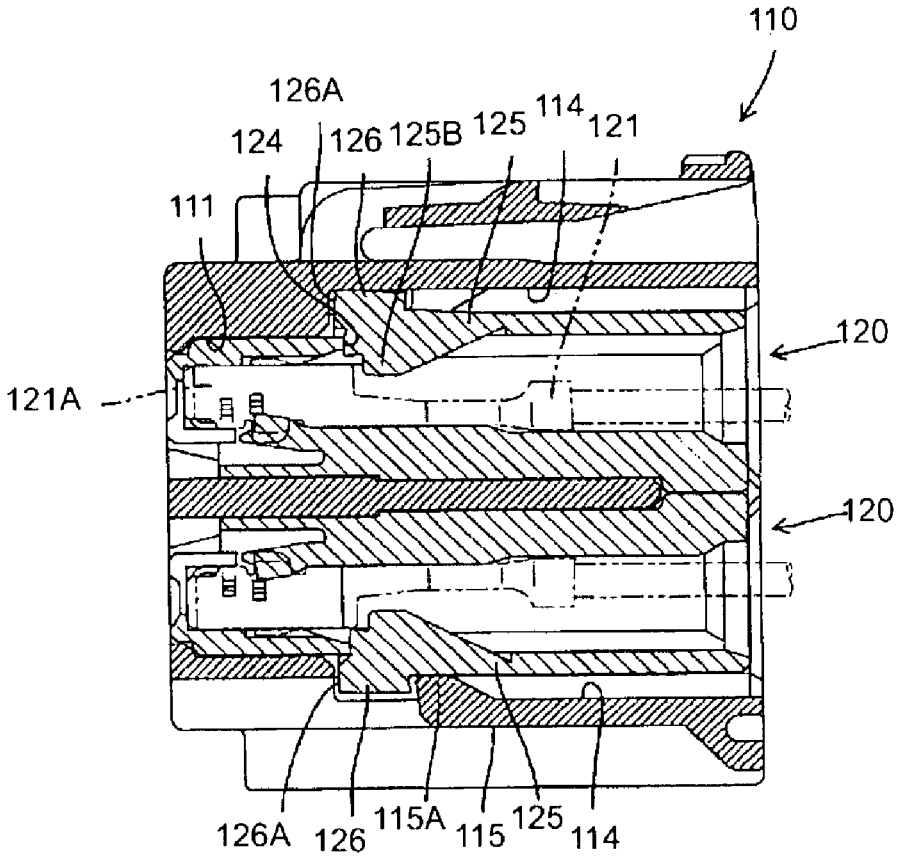
FIG. 22 is a side view showing a state where an opening deformation of the retainer is hindered.

The locking recesses 125C of the retainer 125 may be disengaged from the front edge of the retainer mount hole 124 due to an impact or the like, and the retainer 125 may open from the closing position. Sufficient opening causes the fastening projections 125B to disengage from the terminal connections 121A of the female terminal fittings 121. The retainer 125 that undergoes an opening deformation does not exert a holding force on the female terminal fitting 121 until the lock projection 126 contacts the bottom surface of the insertion groove 114. The retainer 125 shown in the comparative example of FIG. 24 has a lock projection 126 with a positively sloped front surface 126C. However, the lock projection 126 on the retainer 125 of this embodiment has a vertically aligned front surface 126A. Thus, as shown in FIG. 22, an angle of displacement of the lock projection 126 is smaller than in the comparative example. Accordingly, sufficient areas of engagement of the fastening projections 125B with the terminal connecting portions 121A will exert sufficient forces to hold the female terminal fittings 121, even if the retainer 125 undergoes an opening deformation until the lock projection 126 contacts the bottom surface of the insertion groove 114.

As described above, the hinge 125A joins the retainer 125 unitarily to the auxiliary housing 120. This simplifies the retainer holding construction and enables the split-type connector to be miniaturized. Further, opening deformation of the retainer 125 from the closing position to a position where the retainer 125 disengages from the female terminal fittings 121 is hindered by the frame 110. Thus, the retainer 125 exerts forces to hold the female terminal fittings 121

The construction of molds is complicated if the lock projection and the retainer are arranged one after the other along forward and backward directions on the same surface in view of the need to remove the connector from the molds. However, in this embodiment, the constructions of the molds can be simplified since the lock projection 126 is formed unitarily on the retainer 125. The lock projection 126 and the retainer 125 could be formed on different surfaces. However, the split-type connector is enlarged transversely if the lock projection is on a side surface of the auxiliary housing. Transverse enlargement of the split-type connector is avoided in this embodiment by providing the lock projection 126 and the retainer 125 on the same surface.

An attempt is made to insert the auxiliary housing 120 erroneously into the accommodating chamber 111 with the closing position unreached by the retainer 125 due to an insufficiently inserted state of the female terminal fitting 121. However, the front surface 126A of the lock projection 126 contacts the opening edge 116A of the accommodating chamber 111, thereby hindering the insertion of the auxiliary housing 120. Accordingly, the auxiliary housing 120 cannot be assembled while the female terminal fitting 121 is inserted insufficiently.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the kinds of the auxiliary connector housings are sorted according to the sizes to the terminal fittings to be accommodated in the foregoing embodiment, they may be sorted according to other factors. For example, even if terminal fittings of the same size are mounted in two mating auxiliary connector housings, the terminal fittings can be prevented from being connected with wrong mating terminal fittings in terms of a circuit construction by sorting the kinds of the auxiliary connector housings and providing the error connection preventing means.

The shape, positions, numbers and the like of the error connection preventing projections can be suitably changed, and the error connection preventing projections may be provided on the female auxiliary connector housings or on both male and female auxiliary connector housings.

Although one auxiliary connector housing is accommodated in each accommodating chamber in the foregoing embodiment, such auxiliary connector housings as to be mounted over a pair of adjacent accommodating chambers may be used according to the present invention.

The lock projection and the retainer may be separately provided.

What is claimed is:

1. A split-type connector assembly, comprising:

a first connector including a first frame with first accommodating chambers and a plurality of kinds of first auxiliary connector housings accommodated in the respective first accommodating chambers;

a second connector including a second frame with second accommodating chambers and a plurality of kinds of second auxiliary connector housings accommodated in the respective second accommodating chambers; and at least one error connection preventing means between the first auxiliary connector housings and the corresponding second auxiliary connector housings and adapted to permit proper connection of the first and second connectors if the auxiliary connector housings of corresponding kinds are opposed to each other, wherein the error connection preventing means comprise error connection preventing projections projecting substantially in a connecting direction from the first auxiliary connector housings and having different shapes depending on the kinds, and corresponding receiving portions formed in the second auxiliary connector housings for receiving only the error connection preventing projections of the first auxiliary connector housings of the corresponding kinds.

2. The split-type connector assembly of claim 1, wherein first terminal fittings in the first auxiliary connector housings and second terminal fittings in the second auxiliary connector housings are connected with each other by properly connecting the first and second connectors.

3. The split-type connector assembly of claim 2, wherein the first and second auxiliary connector housings differ in kind depending on the sizes of the terminal fittings mounted therein.

4. The split-type connector of claim 1, wherein the error connection preventing projections are received in the corresponding receiving portions to permit proper connection of the connectors if the auxiliary connector housings of corresponding kinds oppose each other, while the error connection preventing projections interfere with the second auxiliary connector housings and prevent proper connection of the connectors if the auxiliary connector housings of uncorresponding kinds opposed each other.

5. A method of assembling a split-type connector assembly, comprising:

providing a first connector including a first frame formed with accommodating chambers;

accommodating a plurality of kinds of first auxiliary connector housings in the respective accommodating chambers of the first connector;

providing a second connector including a second frame formed with accommodating chambers;

accommodating a plurality of kinds of second auxiliary connector housings in the respective accommodating chambers;

engaging the first and second connectors with each other; and detecting if the auxiliary connector housings of uncorresponding kinds are opposed to each other upon connection by means of error connection preventing means between the auxiliary connector housings, wherein the error connection preventing means project substantially in a connecting direction from the first auxiliary connector housings and have different shapes depending on the kinds, and corresponding receiving portions formed in the second auxiliary connector housings for receiving only the error connection preventing projections of the first auxiliary connector housings of the corresponding kinds, and wherein proper connection of the two connectors is permitted by the error connection preventing projections being received into the corresponding receiving portions if the auxiliary connector housings of corresponding kinds are opposed to each other while being hindered by the error connection preventing projections interfering with the second auxiliary connector housings if the auxiliary connector housings of uncorresponding kinds are opposed to each other.

* * * * *